US007552831B2

(12) United States Patent
Catton

(10) Patent No.: US 7,552,831 B2
(45) Date of Patent: Jun. 30, 2009

(54) REVERSIBLE NIPPLE ADAPTER

(76) Inventor: Morris Catton, 123 Van Sicklen St., Brooklyn, NY (US) 11223

( * ) Notice: Subject to any disclaimer, the term of this patent is extended or adjusted under 35 U.S.C. 154(b) by 195 days.

(21) Appl. No.: 11/267,081

(22) Filed: Nov. 3, 2005

(65) Prior Publication Data

US 2007/0095778 A1 May 3, 2007

(51) Int. Cl.
*A61J 11/04* (2006.01)
*A61J 11/00* (2006.01)

(52) U.S. Cl. ..... 215/11.1; 215/228; 215/319; 220/287; 220/711

(58) Field of Classification Search ..... 215/11, 215/1, 276, 391, 228; 220/287, 711, 717
See application file for complete search history.

(56) References Cited

U.S. PATENT DOCUMENTS

| | | | | | |
|---|---|---|---|---|---|
| 2,760,665 | A * | 8/1956 | Zenker | 215/11.1 |
| RE25,247 | E * | 9/1962 | Barr | 215/11.1 |
| 3,820,675 | A * | 6/1974 | Malles | 215/212 |
| 3,827,593 | A * | 8/1974 | Kramb et al. | 215/208 |
| 4,197,955 | A * | 4/1980 | Luenser | 215/252 |
| 4,266,813 | A * | 5/1981 | Oliver | 285/12 |
| 4,336,891 | A * | 6/1982 | Smith | 215/276 |
| 4,583,668 | A * | 4/1986 | Maynard, Jr. | 222/529 |
| 4,850,496 | A * | 7/1989 | Rudell et al. | 215/12.1 |
| 5,078,289 | A * | 1/1992 | Bolton et al. | 215/228 |
| 5,551,583 | A * | 9/1996 | Sachathamakul et al. | 215/386 |
| 5,573,281 | A * | 11/1996 | Keller | 285/40 |
| 5,810,212 | A * | 9/1998 | Santagiuliana | 222/546 |
| 5,884,678 | A * | 3/1999 | Chudy | 141/319 |
| 6,390,315 | B1 * | 5/2002 | Giddings et al. | 215/235 |
| 6,415,937 | B1 * | 7/2002 | DeJong et al. | 215/386 |
| 6,814,267 | B2 * | 11/2004 | Ingram | 222/520 |
| 6,851,565 | B2 | 2/2005 | Stephan | |
| 6,877,626 | B2 * | 4/2005 | Sherrod | 215/319 |
| 2003/0051753 | A1 * | 3/2003 | Stevens | 137/205 |

* cited by examiner

*Primary Examiner*—Sue A Weaver
(74) *Attorney, Agent, or Firm*—Amster, Rothstein & Ebenstein LLP

(57) ABSTRACT

A nipple adapter including a nipple having a first outer sealing flange and a second outer sealing flange, and a cylindrical nipple housing. The nipple housing includes an inner annular wall that defines a bore extending axially through the housing, an annular flange disposed on the inner annular wall, a first thread extending from the annular flange to a first axial end of the nipple housing, and a second thread extending from the annular flange to a second axial end of the nipple housing, the first thread having a pitch that differs from that of the second thread. The nipple is reversibly disposed within the nipple housing such that the annular flange is disposed between the first and second outer sealing flanges and the first and second threads are alternatively exposed for mating with corresponding threads of a variety of water bottles.

2 Claims, 4 Drawing Sheets

FIG.5C
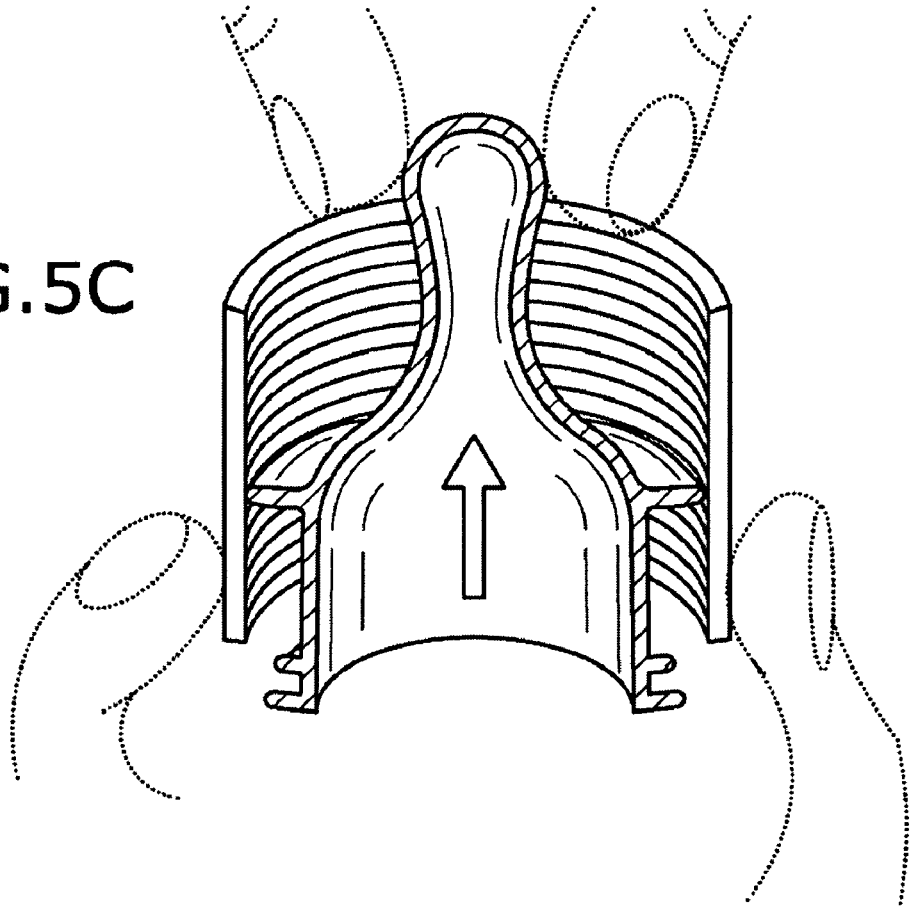
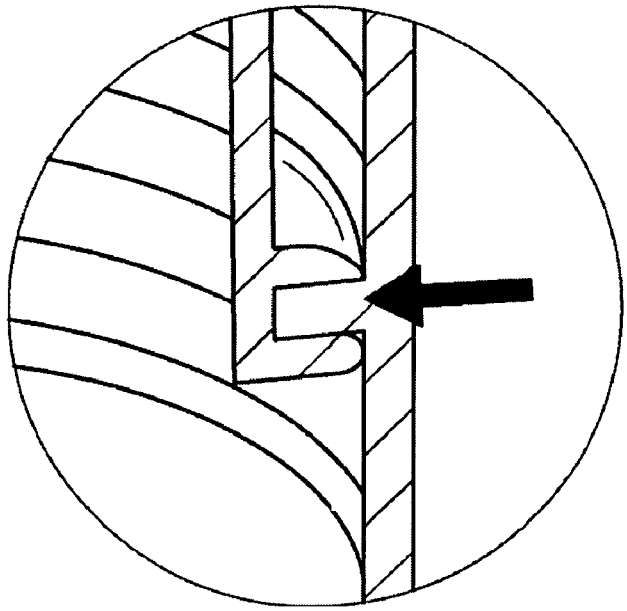
FIG.5D

REVERSIBLE NIPPLE ADAPTER

TECHNICAL FIELD

The present invention is related to infant beverage dispensers.

BACKGROUND

Conventional baby bottles with nipples are not easily filled with drinking fluids, such as water or juice. Further, conventional juice and water bottles are not adaptable for use with an infant's nipple. Thus, there have been attempts to design nipple adapters that can be fitted on a typical beverage bottle in place of the bottle cap. For example, U.S. Pat. No. 6,851,565 to Stephan discloses a nipple adapter including a collar having female threads for mating with the outer male bottle-top threads of a conventional narrow-diameter threaded-cap beverage container. However, as with the other known nipple adapter designs, the nipple adapter of the '565 Patent can only be used on standard beverage bottles having a specific thread pitch.

Accordingly, there is a need for a nipple adapter having a relatively simple construction that can be used on a variety of beverage bottles having differing thread pitches.

SUMMARY OF THE INVENTION

One aspect of the invention provides a nipple adapter having a relatively simple construction for easy placement on and removal from a variety of beverage bottles.

Another aspect of the invention provides a nipple adapter that can be used on a variety of beverage bottles having differing thread pitches.

A nipple adapter according to an exemplary embodiment of the invention includes a nipple having a first outer sealing flange and a second outer sealing flange, and a cylindrical nipple housing. The nipple housing includes an inner annular wall that defines a bore extending axially through the housing, an annular flange disposed on the inner annular wall, a first thread extending from the annular flange to a first axial end of the nipple housing, and a second thread extending from the annular flange to a second axial end of the nipple housing, the first thread having a pitch that differs from that of the second thread. The nipple is reversibly disposed within the nipple housing such that the annular flange is disposed between the first and second outer sealing flanges and the first and second threads are alternatively exposed for mating with corresponding threads of a variety of water bottles.

A nipple adapter according to another exemplary embodiment of the invention includes a nipple and a cylindrical nipple housing. The nipple housing includes an inner annular wall that defines a bore extending axially through the housing, a first thread extending from an intermediate portion of the inner annular wall to a first axial end of the nipple housing, and a second thread extending from the intermediate portion of the inner annular wall to a second axial end of the nipple housing, the first thread having a pitch that differs from that of the second thread. The nipple is reversibly disposed within the nipple housing such that the first and second threads are alternatively exposed for mating with corresponding threads of a variety of water bottles.

These and other features of this invention are described in, or are apparent from, the following detailed description of various exemplary embodiments of this invention.

BRIEF DESCRIPTION OF THE DRAWINGS

Various exemplary embodiments of this invention will be described in detail, with reference to the following figures, wherein:

FIGS. 5A-5D show a method of reversing the nipple adapter of FIG. 1 such that a thread having a different sized pitch is exposed.

DETAILED DESCRIPTION OF PREFERRED EMBODIMENTS

Figure 1:
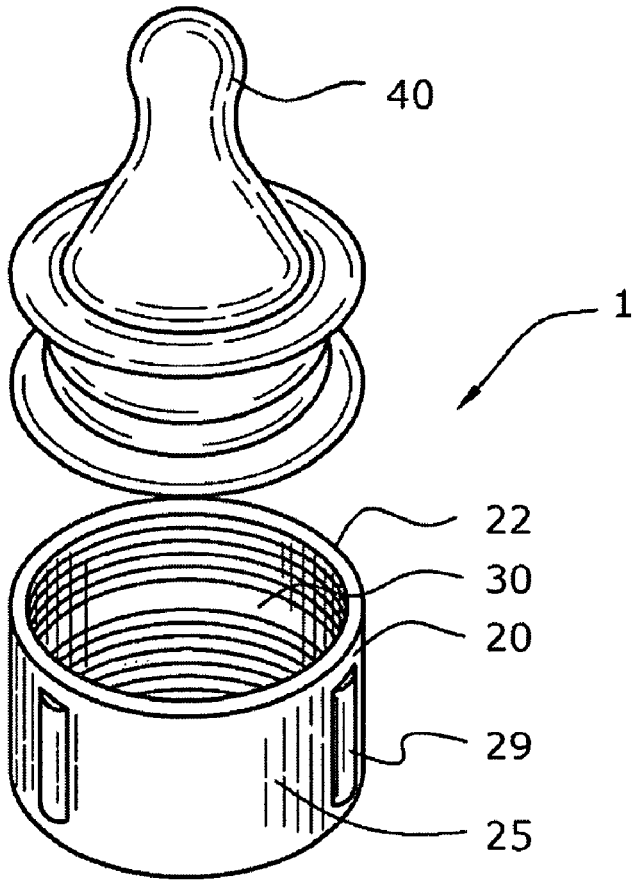
FIG. 1 is an exploded perspective view of a nipple adapter according to an exemplary embodiment of the invention.
Figure 2:
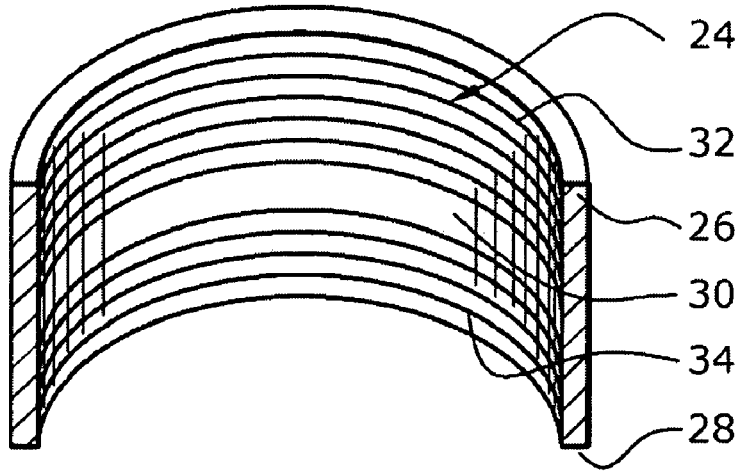
FIG. 2 is a cross sectional view of a housing of the nipple adapter of FIG. 1.

FIG. 1 is an exploded perspective view of a nipple adapter 1 according to an exemplary embodiment of the invention. The nipple adapter 1 includes a nipple 40 and a housing 20. The housing 20 is cylindrical in shape and includes an inner annular wall 22 that defines a bore 24 extending through the housing 20, first and second end annular walls 21 and 23 and an outer annular wall 25. More specifically, as shown in FIG. 2, which is a cross sectional view of the housing 20, the bore 24 extends from a first axial end 26 of the housing 20 to a second axial end 28 of the housing 20. The inner annular wall 22 includes an annular flange 30 disposed intermediate the first axial end 26 and the second axial end 28, a first thread 32 extending from the annular flange 30 to the first axial end 26 and a second thread 34 extending from the annular flange 30 to the second axial end 28. Preferably, the first thread 32 has a pitch that differs from that of the second thread 34. In this embodiment, the first thread 32 has a larger pitch than that of the second thread 34. Protrusions 29 may be formed around the outer annular wall 25. The protrusions 29 may be axially extending and circumferentially spaced so as to form grip members for the user to grip and turn the housing 20.

Figure 3:
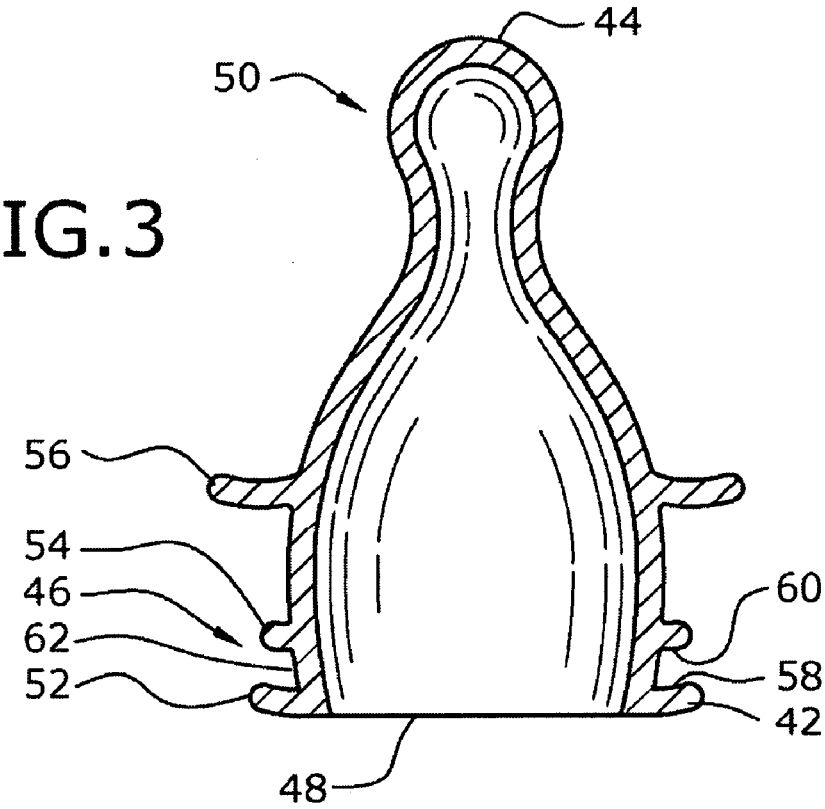
FIG. 3 is a cross sectional view of a nipple of the nipple adapter of FIG. 1.

As shown in FIG. 3, the nipple 40 includes a first end 42 and a second end 44. A base portion 46 is disposed proximal the first end 42 and a teat portion 50 is disposed proximal the second end 44. The base portion 46 includes a first annular sealing flange 52 disposed at the first end 48 of the nipple 40, a second annular sealing flange 54 spaced axially from the first annular sealing flange 52 and an annular cover flange 56 disposed intermediate the first end 42 and the second end 44. The first annular sealing flange 52 includes a top wall 58 and the second annular sealing flange 54 includes a bottom wall 60. Both the top wall 58 and the bottom wall 60 lie in a plane perpendicular to the axis of the nipple 40. The space between the top wall 58 of the first annular sealing flange 52 and the bottom wall 60 of the second annular sealing flange 54 forms an annular groove 62.

Figure 4:
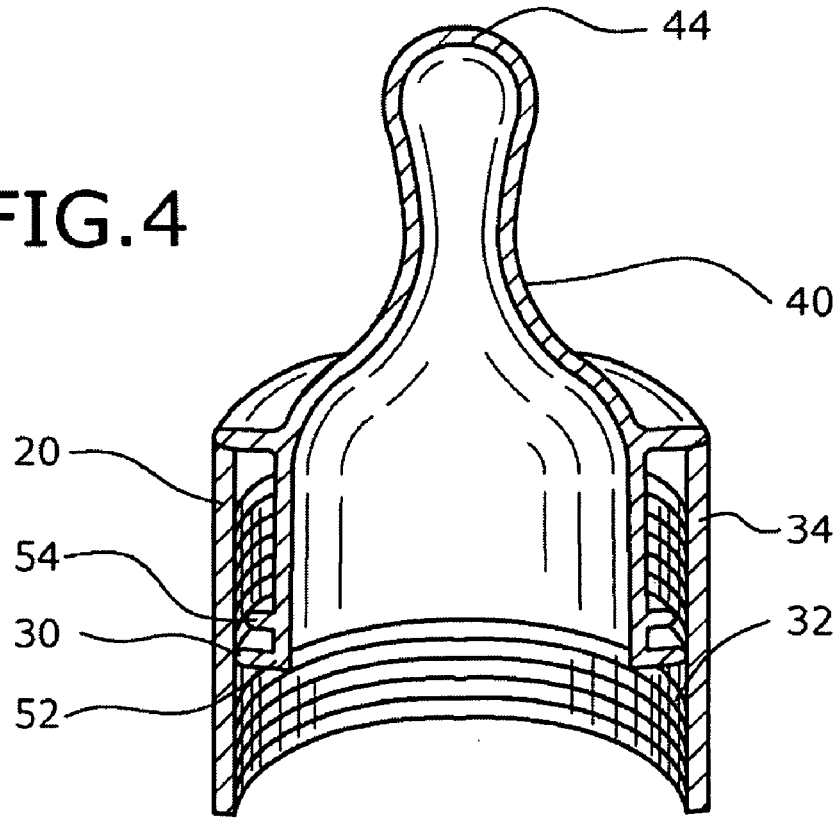
FIG. 4 is a cross sectional view of the nipple adapter of FIG. 1 fully assembled.

FIG. 4 is a cross section view of the nipple adapter 1 fully assembled with the nipple 40 disposed within the housing 20. The nipple 40 is positioned within the housing 20 such that the annular flange 30 is disposed within the groove 62. Thus, the first and second annular sealing flanges 52 and 54 are able to create a leak-proof seal. Also, when fully assembled, the annular cover flange 56 covers either the first end annular wall

21 or the second end annular wall 23, depending on whether the first thread 32 or second thread 34 is exposed.

Figure 5A:
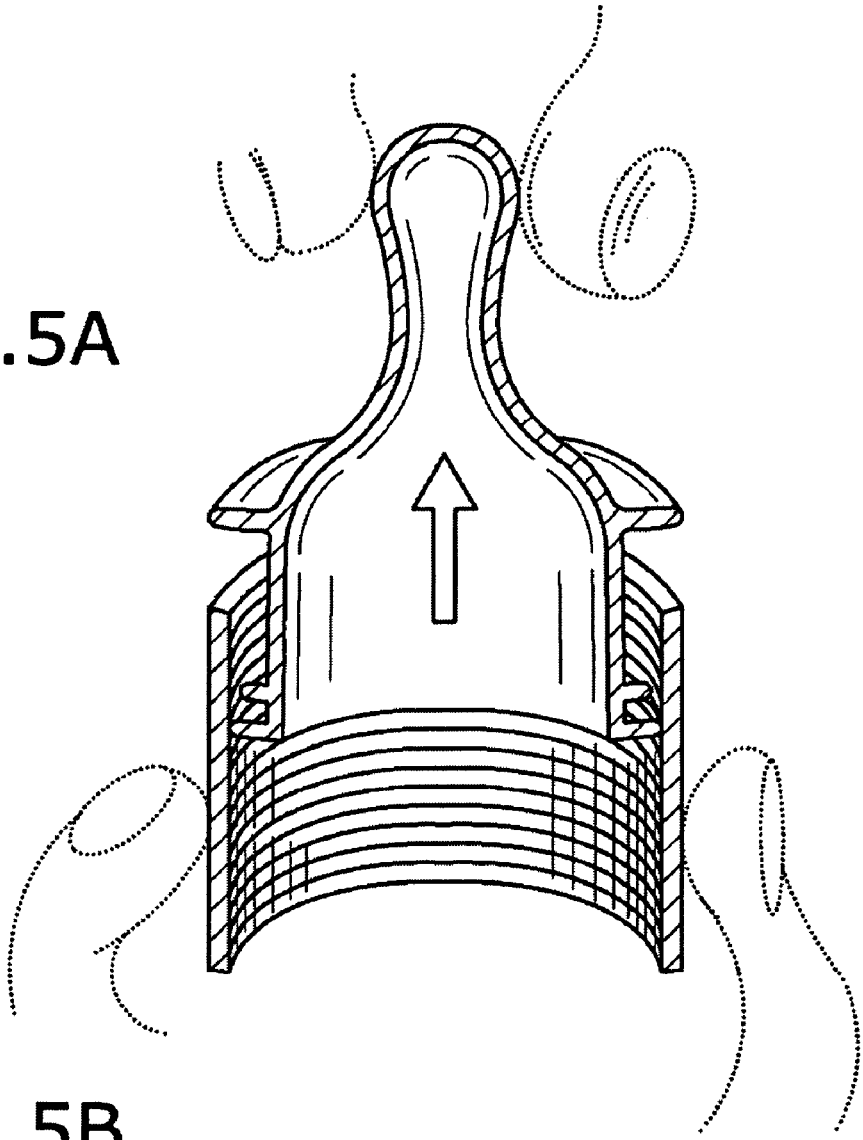
Figure 5B:
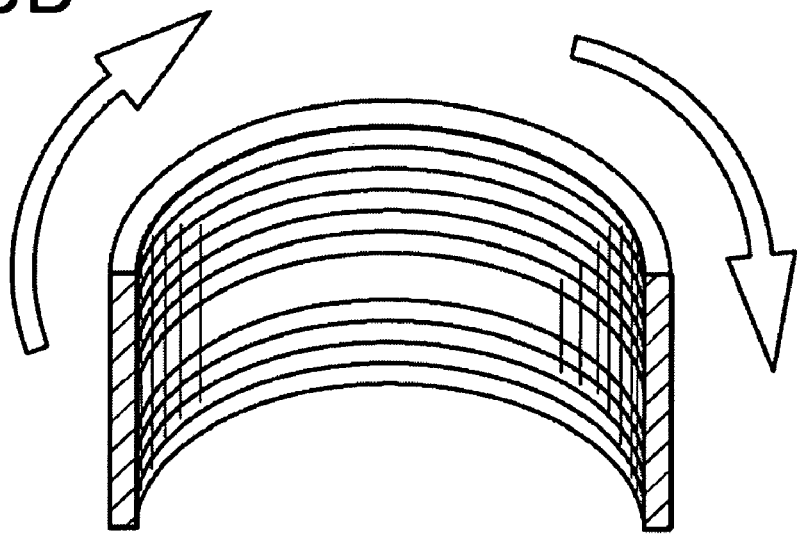

FIG. 4 shows the nipple adapter 1 assembled with the larger pitched first thread 32 exposed for mating with corresponding threads of a water bottle. However, as shown in FIGS. 5A-5D, the nipple adapter 1 can be reversed to expose the smaller pitched second thread 34. Specifically, as shown in FIG. 5A, a user may grasp the teat portion 50 of the nipple 40 and pull the nipple 40 upwards and out of the second axial end 28 of the housing 20. As shown in FIG. 5B, the user may then reverse the housing 40 so that the smaller sized second thread 34 is on the bottom. As shown in FIGS. 5C and 5D, the user may then dispose the teat portion 50 of the nipple 40 within the second axial end 28 of the housing 20, grasp the teat portion 50 and pull the nipple 40 through the bore 24 of the housing 20 until the annular flange 30 is disposed within the groove 62. The nipple adapter 1 is now assembled with the smaller pitched second thread 34 exposed so as to be compatible with water bottles having smaller pitched mating threads.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A nipple adapter comprising:

a nipple comprising a first outer sealing flange, a second outer sealing flange, a first end, a second end opposite the first end, a base portion proximal the first end, and a teat portion proximal the second end, the base portion comprising the first and second outer sealing flanges; and a cylindrical nipple housing comprising:

an inner annular wall that defines a bore extending axially through the housing;

an annular flange disposed on the inner annular wall;

a first thread extending from the annular flange to a first axial end of the nipple housing; and a second thread extending from the annular flange to a second axial end of the nipple housing, the first thread having a pitch that differs from that of the second thread, the nipple being reversibly disposed within the nipple housing such that the annular flange is disposed between the first and second outer sealing flanges and the first and second threads are alternatively exposed for mating with corresponding threads of a variety of water bottles, the base portion further comprising a cover flange, the cover flange covering one of the first and second axial ends of the nipple housing.

2. The nipple adapter of claim 1, wherein the nipple housing further comprises;

an outer annular wall; and circumferentially spaced protrusions for gripping the nipple housing.

* * * * *